US005177341A

United States Patent [19]

Balderson

[11] Patent Number: 5,177,341

[45] Date of Patent: Jan. 5, 1993

[54] THICK FILM ELECTRICALLY RESISTIVE TRACKS

[75] Inventor: Simon Balderson, Reading, England

[73] Assignee: Thorn EMI plc, London, England

[21] Appl. No.: 159,916

[22] Filed: Feb. 24, 1988

[30] Foreign Application Priority Data

Feb. 25, 1987 [GB] United Kingdom ..... 8704469

[51] Int. Cl.[5] ..... H05B 3/16

[52] U.S. Cl. ..... 219/543; 219/468; 219/445; 219/446; 392/438; 338/307; 338/308; 338/292

[58] Field of Search ..... 219/543, 466, 468, 443, 219/446, 345, 464, 216, 445; 338/283, 287, 288, 289, 292, 295, 294, 301, 280, 306, 307, 308, 309, 22 R

[56] References Cited

U.S. PATENT DOCUMENTS

| | | | |
|---|---|---|---|
| 2,603,740 | 7/1952 | Buttero | 338/308 X |
| 3,180,999 | 4/1965 | Kuyendall | 219/508 X |
| 3,331,945 | 7/1967 | Ishikawa et al. | 219/508 X |
| 3,564,475 | 2/1971 | Fujii et al. | 338/287 X |
| 3,647,532 | 3/1972 | Friedman et al. | 117/212 |
| 3,813,520 | 5/1974 | Brouneus | 219/543 |
| 3,895,218 | 7/1975 | Cooke | 219/203 X |
| 3,928,837 | 12/1975 | Esper et al. | 338/22 R |
| 4,002,883 | 1/1977 | Hurko | 219/543 |
| 4,065,848 | 1/1978 | Dery | 219/203 X |
| 4,242,565 | 12/1980 | Schoon | 219/216 |
| 4,730,103 | 3/1988 | Hawkins | 338/22 R X |

FOREIGN PATENT DOCUMENTS

| | | |
|---|---|---|
| 469075 | 1/1975 | Australia . |
| 0164900 | 12/1985 | European Pat. Off. . |
| 990023 | 4/1965 | United Kingdom . |
| 1463317 | 2/1977 | United Kingdom . |
| 2132060B | 6/1984 | United Kingdom . |

*Primary Examiner*—Marvin M. Lateef
*Attorney, Agent, or Firm*—Keck, Mahin & Cate

[57] ABSTRACT

In a thick film water track, irrespective of track thickness or the material of which the track is constructed, the optimum track width is found to be in the range of from 1.2 mm to 2.1 mm. Further, for a given resistance, the track is longer and may be conformed to a pattern to give improved temperature distribution. Additionally disclosed is a heating element having a number of thick film electrically resistive tracks applied to the surface of an electrically insulative substrate and a switch for selectively connecting one or more of the tracks to a power supply. The resistance and hence the operating temperature of the heating element may be varied by changing the track or tracks connected to the switch.

20 Claims, 5 Drawing Sheets

THICK FILM ELECTRICALLY RESISTIVE TRACKS

This invention relates to thick film electrically resistive tracks, and it relates especially, though not exclusively, to such tracks as may be used as heating elements, for example in cooker hob units of or for domestic cookers.

It has been proposed that such tracks be deposited upon a glass ceramic surface of a composite support member comprising a metallic support plate coated with glass ceramic material. In these circumstances, the track is overglazed with a glass ceramic material to protect the thick film tracks and allow high temperature stable operation. The entire heating unit so produced can be mounted closely adjacent the underside of a glass ceramic cooktop to provide a heated area on the cooktop. Clearly more than one such heating unit, or a unitary support member bearing more than one heater track, can be used to provide more than one heated area on the glass ceramic cooktop.

The material of which the resistive track is formed may be a material, such as nickel, or a nickel alloy, which exhibits a high temperature coefficient of resistance, i.e. in excess of 0.006 per degree C. in the temperature range of from 0° C. to 550° C., as described in our co-pending U.S. patent application Ser. No. 159,675, or a precious metal or any other suitable material. The composite support member preferably bears a glass ceramic coating of low porosity as described in our co-pending U.S. patent application Ser. No. 159,674.

In determining the physical dimensions of the track which is to form the heating element, it is usual to determine its desired overall resistance at a given temperature and then evaluate, on an ohms-per-square basis, taking into account a reasonable length and configuration for the track, the width of track to be deposited at a given thickness.

The inventor has found that if such a strategy is followed, the performance of the track so deposited tends to be less than satisfactory and it is believed that one reason for this is that the relatively wide tracks which result from the conventional approach exhibit differential thermal characteristics which tends to cause higher currents to pass through the edges of the track than through the centre thereof. This causes localised "hot spots" to occur and renders the track susceptible to damage due to local breakdown particularly in areas central of the track's width, from which heat dissipation is severely restricted.

The inventor has analysed the relative performances of tracks of different dimensions and has found that, irrespective of track thickness or the material of which the track is constructed, the optimum track width is in the range of from 1.2 mm to 2.1 mm, preferably in the range of from 1.5 mm to 2.0 mm. This, of course, means that a much longer track has to be accommodated for a given resistance than hitherto, but this can be advantageous in permitting the elongated track to conform to a pattern which gives improved temperature distribution over the heated area, with the consequence that the incidence of warping of the substrate as a result of localised "hot spots" is reduced.

Embodiments of the invention will now be described by way of example only and with reference to the accompanying drawings in which.

Figure 1:
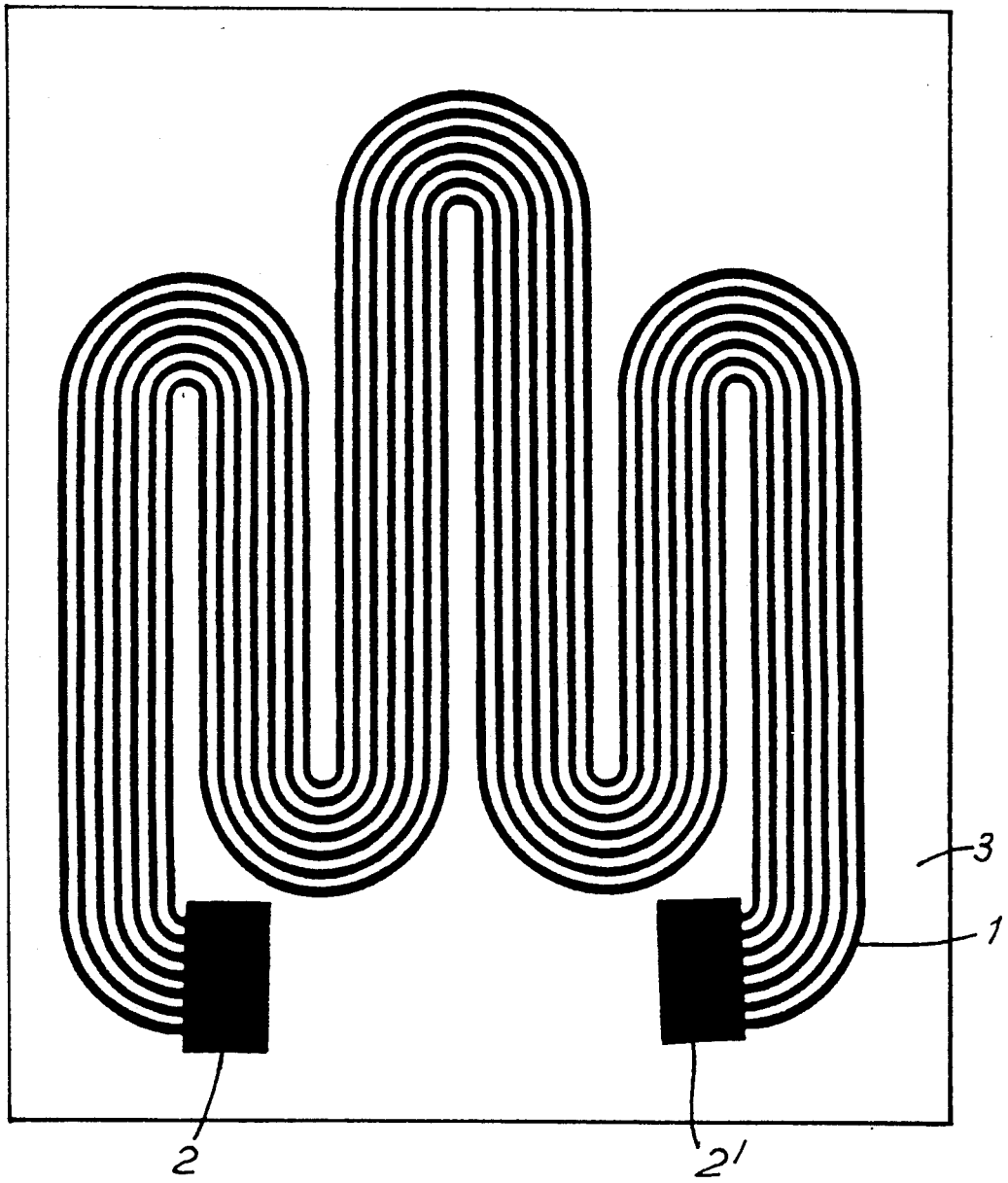
FIG. 1 shows a first embodiment of a heating element comprising a plurality of tracks, each track being in accordance with a first aspect of the present invention.

One particularly advantageous development is shown in FIG. 1 of the attached drawings, which shows a track 1 with terminals 2, 2' on a substrate 3 and illustrates an example of track configuration in accordance with the invention, the track material typically being a thick film including Nickel or an alloy of silver and palladium, although other materials may be used. A second example of a track configuration is shown in FIG. 2 which shows a track 4 with terminals 5, 5' on a substrate 6.

It will be observed that a plurality of tracks are provided, electrically in parallel with one another, each track being of the aforesaid optimum width and of length allowing for the parallel configuration of the tracks and the desired overall resistance at a given temperature. As well as providing excellent track coverage over the heated area, with improved eveness of heat distribution, and in addition to the aforementioned benefits which arise from causing the track width to lie within the aforesaid range of values, the layouts shown in the drawings have the advantage that the element as a whole will continue working even if one track (or possibly more) should be damaged or broken, albeit with slightly different electrical characteristics than were exhibited prior to the damage or break.

It is not necessary for each of the various parallel-connected tracks to follow the same course and it may be advantageous in some circumstances to cause some of the tracks to follow other courses in order to achieve a desired overall heating profile for the element as a whole.

Figure 2:
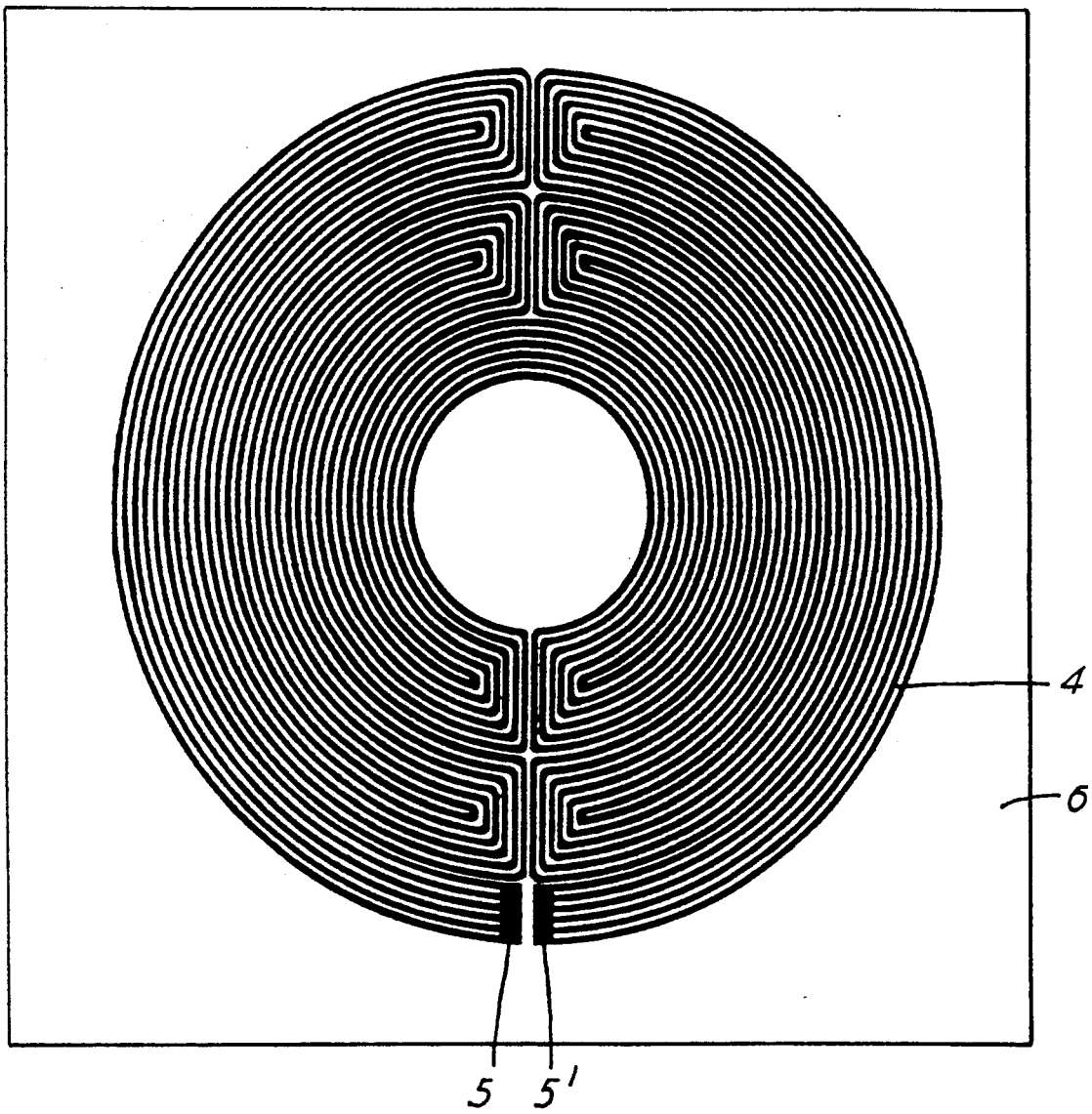
FIG. 2 shows a second embodiment of a heating element comprising a plurality of tracks, each track being in accordance with the first aspect of the present invention.

The kind of parallel track configuration described with reference to FIGS. 1 and 2 provides the option to achieve a further objective which is regarded as inventive and which will now be described.

Conventional techniques for controlling the temperature of a cooker hob element below its maximum value involve cyclically connecting and disconnecting the mains supply to and from the element at a rate determined by the temperature required, and thus the regulator setting selected. This thermostatically controlled voltage cycling gives rise to a very uneven temperature/time profile which is apparently a disadvantage when cooking and which increases the likelihood of element failure due to thermal cycling induced stress. Such a control technique also requires sensors and electronics which may be expensive and prone to occasional failure.

These problems can be overcome by controlling the temperature of heater elements by switching between heater tracks of different resistance as required. These tracks can be configured in a number of different ways. For example, several discrete tracks of different resistances can be applied to the same substrate, either side by side or crossing over each other (using a suitable crossover dielectric layer). The resistance difference can be achieved by using either different track materials or track geometries. Another alternative involves a main track design to which extra lengths are added or removed as the regulator setting is varied.

Figure 3:
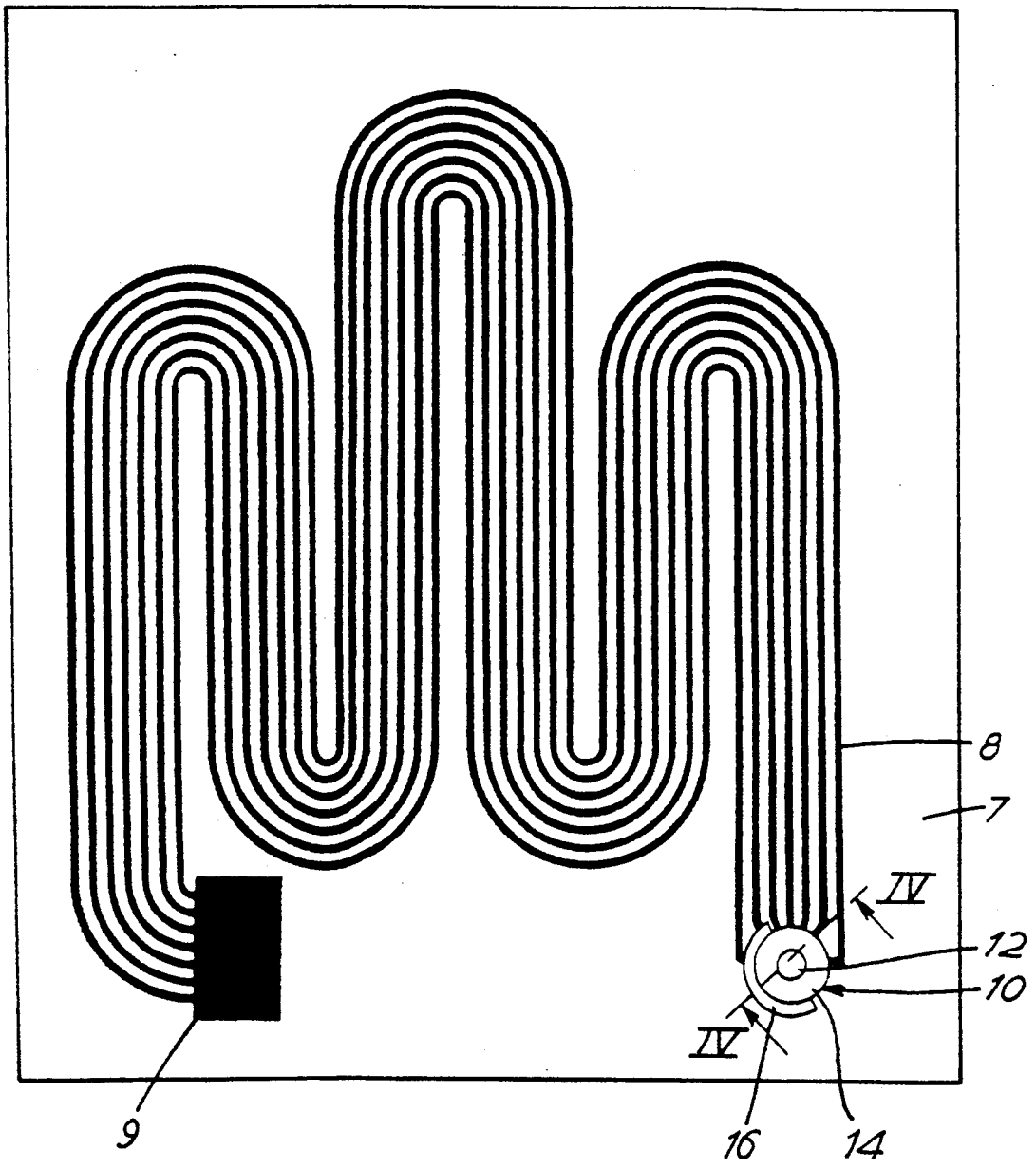
FIG. 3 shows a heating element comprising a plurality of tracks with a control switch in accordance with a second aspect of the present invention.
Figure 4:
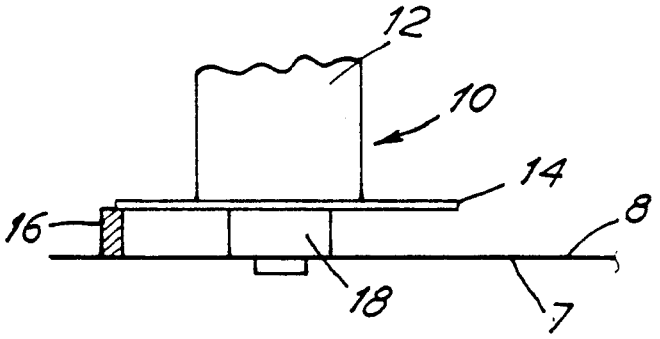
FIG. 4 shows a section of the control switch along the line IV—IV of FIG. 3.

A further design involves printing the track as a combination of several similar tracks in parallel as shown in FIG. 3. The low temperature setting utilises just one of these tracks and higher settings use proportionally more. FIG. 3 shows, on a substrate 7, a parallel track configuration 8 having two terminals 9, one of which is a sliding contact switch 10, which in practice may be electronically controlled and/or linked to a manual selector arrangement, and which selectively connects the mains input leads (not shown) to the various tracks, and combination of tracks, enabling parallel tracks to be energised track by track, as desired to increase the temperature setting. The switch must provide sufficient pressure to make contact with the tracks but not so much as to damage the tracks. As shown in FIG. 4, the contact switch 10 comprises a rotatable spindle 12 for a control knob (not shown) with a support plate 14 bearing carbon brushes 16. The support plate 14 is mounted on an insulating bearing 18.

In order for the switch to make electrical contact with the tracks, it is necessary for the area of the tracks below the switch to be clear of overglaze material. In the case where the tracks are made of a material such as nickel which may deteriorate on exposure to air due to oxidation of the material at the high temperatures of the track in use, the tracks in this exposed area below the switch may be made of a more stable material such as palladium or a silver/palladium alloy. Alternatively the control switch 10 may be sited remote from the heater element so that the area of the tracks exposed to air is not exposed to temperatures high enough to cause oxidation of the tracks.

The temperature control of the heating element and substrate may be further improved by the use of a thick film temperature sensor. The printed format of the sensor track allows direct temperature monitoring of the surface of the substrate and avoids the problem of hysteresis associated with known temperature sensors, such as bimetal strips, which, because of their configuration, must necessarily be distant from the surface of the substrate. This is particularly advantageous where the substrate is a glass ceramic substrate as electrical breakdown may occur in the glass ceramic layer when the temperature exceeds 550° C. Advantageously, the temperature sensor comprises a thick film track made of a material having in the temperature range of from 0° C. to 550° C. a temperature coefficient of resistance in excess of 0.006 per degree C. The considerable variation in resistance of such a track with temperature can be used to monitor the temperature of the substrate.

Figure 5:
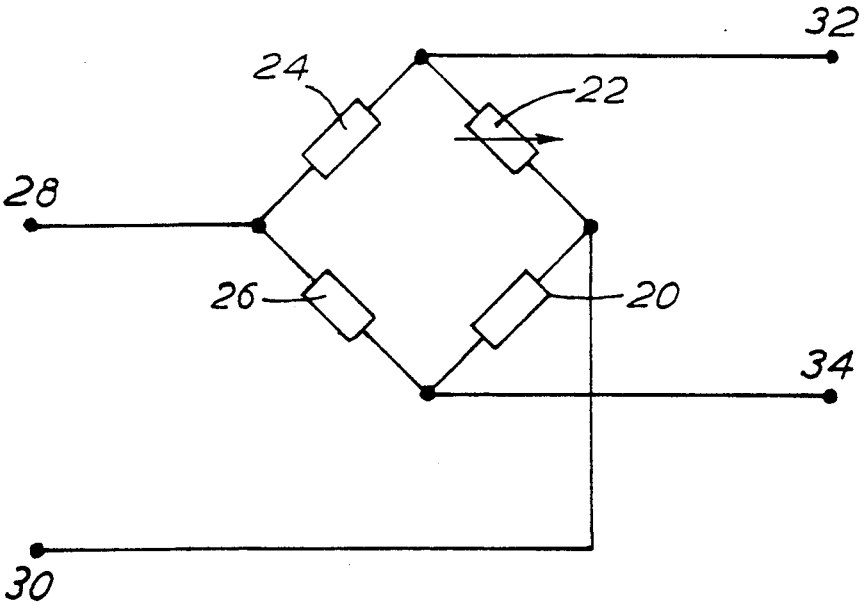
FIG. 5 shows an electrical circuit suitable for use with a temperature sensor track.

The regulation of the temperature of the substrate using a sensor track may be achieved by the use of a suitable electrical circuit to compare the resistance of the sensor track with that of a variable resistor whose resistance is set to correspond to that of the required temperature. One example of an electrical circuit suitable for use with a sensor track is shown in FIG. 5, where the resistance 20 is the resistance of the sensor track and the variable resistor 22 is pre-set to a resistance corresponding to a required temperature. Constant resistances 24, 26, having the same value, form the other two sides of a bridge circuit having input terminals 28, 30 and output terminals 32, 34. When a potential difference is applied to the input terminals 32, 34 only falls to zero when the resistance 20 of the sensor track is the same as that of the variable resistor 22, i.e. when the sensor track and substrate are at the required temperature. This zero potential difference can be used to switch the power supply. Other circuits suitable for comparing resistances may also be used.

Figure 6:
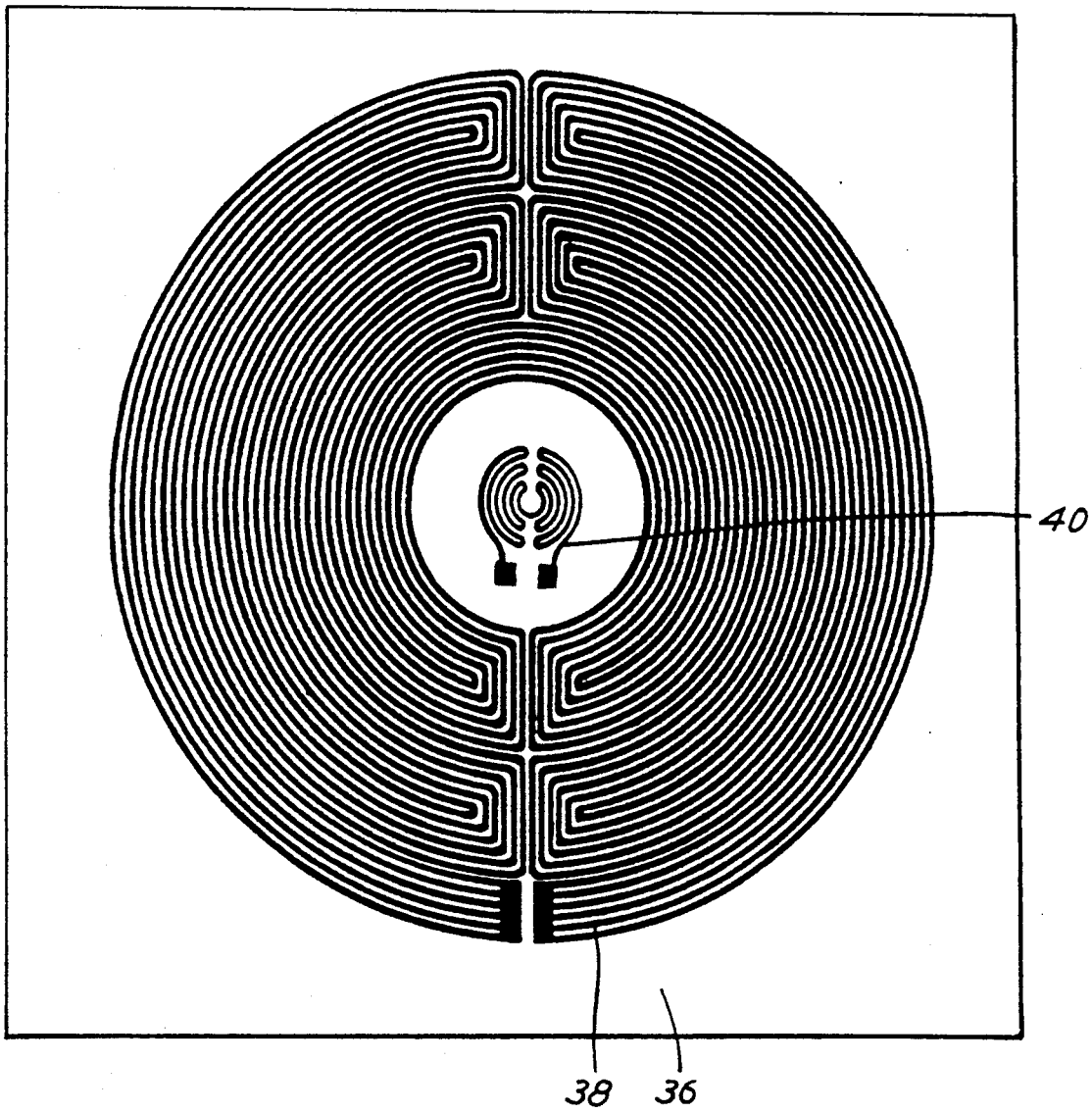
FIG. 6 shows, applied to a substrate, a heating element and a temperature sensor track.

A suitable pattern for the sensor track is shown in FIG. 6 (external connections not shown) which shows a substrate 36 bearing a heating element 38 and a sensor track 40. Alternatively, to spot local hot spots, a sensor track could be interleaved with the tracks of the heating element, so covering the same area of the substrate as the heating element. Other suitable configurations for the heating element and sensor may be used. The thick film tracks for the heating element and the sensor may be manufactured in the same process.

After the electrically resistive tracks have been applied to the substrate, external connections are added. A suitable electrical connector for making a connection to a thick film track has a cross-sectional area suitable for the required current carrying capacity and comprises a plurality of conductive fibres braided together, each of the fibres having a diameter, preferably in the range of from 30 μm to 300 μm, so as to provide sufficient stiffness to the connector and to permit adhesion of the connector to the thick film track. The connector may be made of various metals, the most suitable metal for a particular application depending in part on the material of the thick film track to which the connector is to be adhered. The connector is adhered to the track using a glass/metal adhesive, advantageously the same conductive ink as used to form the thick film track.

As aforementioned, the whole is then overglazed using a protecting glass or glass ceramic overglaze to protect the thick film tracks and allow high temperature stable operation.

I claim:

1. A heating unit comprising an elongate thick film electrically resistive track of substantially constant width of between 1.2 and 2.1 millimeters along its length, to permit substantially even heat distribution over the length and width of the track, the length to width ratio being at least 10 to 1, the track being supported on a substrate of electrically insulative material, the track being configurated to achieve a predetermined heating profile.

2. A heating unit according to claim 1 wherein the width of said track is in the range 1.5 to 2.0 millimeters.

3. A heating unit according to claim 1 comprising a plurality of said tracks, said plurality of tracks being supported on said substrate of electrically insulative material and connected electrically in parallel with one another.

4. A heating unit according to claim 2 comprising a plurality of said tracks, said plurality of tracks being supported on said substrate of electrically insulative material and connected electrically in parallel with one another.

5. A heating unit according to claim 1 comprising a plurality of said thick film electrically resistive tracks supported on the surface of said electrically insulative substrate and switching means for selectively connecting one or more of said tracks to a power supply whereby the resistance and hence the operating temperature of said heating unit may be varied by changing the track or tracks connected to said switching means.

6. A heating unit according to claim 3 wherein each of said plurality of tracks has a different resistance.

7. A heating unit according to claim 4 wherein each of said plurality of tracks has a different resistance.

8. A heating unit according to claim 5 wherein each of said plurality of tracks has a different resistance.

9. A heating unit according to claim 6 wherein at least one of said plurality of tracks is made of a different material from the other tracks.

10. A heating unit according to claim 7 wherein at least one of said plurality of tracks is made of a different material from the other tracks.

11. A heating unit according to claim 8 wherein at least one of said plurality of tracks is made of a different material from the other tracks.

12. A heating unit according to claim 5 wherein at least one of said plurality of tracks is made of a material having in the range of from 0° C. to 550° C. a temperature coefficient of resistance in excess of 0.006 per degree C.

13. A heating unit according to claim 6 wherein at least one of said plurality of tracks is made of a material having in the range of from 0° C. to 550° C. a temperature coefficient of resistance in excess of 0.006 per degree C.

14. A heating unit according to claim 9 wherein at least one of said plurality of tracks is made of a material having in the range of from 0° C. to 550° C. a temperature coefficient of resistance in excess of 0.006 per degree C.

15. A heating unit according to claim 5, said operating temperature being determined by the resistance of a track connected to said switching means wherein said operating temperature may be altered by changing the track connected to said switching means.

16. A heating unit according to claim 6, said operating temperature being determined by the resistance of a track connected to said switching means wherein said operating temperature may be altered by changing the track connected to said switching means.

17. A heating unit according to claim 9, said operating temperature being determined by the resistance of a track connected to said switching means wherein said operating temperature may be altered by changing the track connected to said switching means.

18. A heating unit according to claim 12, said operating temperature being determined by the resistance of a track connected to said switching means wherein said operating temperature may be altered by changing the track connected to said switching means.

19. A heating unit according to claim 5, wherein said operating temperature may be altered by changing the number of tracks electrically connected in parallel to one another, said number of tracks being connected to said switching means.

20. A heating unit according to claim 12, wherein said operating temperature may be altered by changing the number of tracks electrically connected in parallel to one another, said number of tracks being connected to said switching means.

* * * * *